US010253499B2

(12) United States Patent
Hercus

(10) Patent No.: US 10,253,499 B2
(45) Date of Patent: Apr. 9, 2019

(54) STRUCTURAL BUILDING ELEMENT

(71) Applicant: AUSTRALIAN ENGINEERED SOLUTIONS Pty Ltd, Dromana, Victoria (AU)

(72) Inventor: Darren Robert Hercus, Dromana (AU)

(73) Assignee: AUSTRALIAN ENGINEERED SOLUTIONS PTY LTD, Victoria (AU)

( * ) Notice: Subject to any disclaimer, the term of this patent is extended or adjusted under 35 U.S.C. 154(b) by 0 days.

(21) Appl. No.: 15/470,176

(22) Filed: Mar. 27, 2017

(65) Prior Publication Data

US 2017/0254082 A1 Sep. 7, 2017

Related U.S. Application Data

(63) Continuation of application No. 14/838,872, filed on Aug. 28, 2015, now abandoned.

(51) Int. Cl.

| | |
|---|---|
| ***E04C 3/16*** | (2006.01) |
| ***E04C 3/17*** | (2006.01) |
| ***E04C 3/42*** | (2006.01) |
| *E04B 1/26* | (2006.01) |

(52) U.S. Cl.

CPC ..... *E04C 3/16* (2013.01); *E04C 3/17* (2013.01); *E04C 3/42* (2013.01); *E04B 2001/264* (2013.01)

(58) Field of Classification Search

CPC ..... E04C 3/16; E04C 3/17; E04C 3/42; E04B 2001/264; E04B 1/26

USPC ..... 52/837

See application file for complete search history.

(56) References Cited

U.S. PATENT DOCUMENTS

| | | | | |
|---|---|---|---|---|
| 2,414,094 | A | 1/1947 | Couelle | |
| 2,727,281 | A * | 12/1955 | Cruciani | E01D 21/00 14/24 |
| 3,490,188 | A | 1/1970 | Troutner | |
| 3,991,535 | A | 11/1976 | Keller et al. | |
| 4,001,999 | A | 1/1977 | Chandler | |
| 4,173,857 | A | 11/1979 | Kosaka | |
| 4,336,678 | A | 6/1982 | Peters | |
| 4,630,424 | A | 12/1986 | Eberle et al. | |
| 4,782,641 | A | 11/1988 | Manenti et al. | |
| 4,854,104 | A | 8/1989 | Pomento | |
| 4,862,653 | A | 9/1989 | Pomento | |
| 5,041,322 | A | 8/1991 | Fouquet | |
| 5,143,418 | A | 9/1992 | Fouquet | |
| 5,195,291 | A | 3/1993 | Pomento | |
| 5,655,347 | A * | 8/1997 | Mahieu | E04C 3/38 14/12 |
| 5,761,872 | A | 6/1998 | Sanford et al. | |
| 5,867,963 | A * | 2/1999 | Hershey | E04C 3/16 52/650.2 |

(Continued)

FOREIGN PATENT DOCUMENTS

AU 2015218559 A1 11/2015

*Primary Examiner* — Brent W Herring

(74) *Attorney, Agent, or Firm* — Pedersen and Company, PLLC; Ken J. Pedersen; Barbara S. Pedersen

(57) ABSTRACT

A timber I-beam 701 has a top chord 702 and a bottom chord 704 forming the flanges of I-beam and a series of side by side timber blocks 706 each separated from the next by a gap 722, together forming a uniplanar, intermittent web. Cables and pipes for a building may run transversely through the gaps 722. A method of making the I-beam is described.

21 Claims, 9 Drawing Sheets

(56) References Cited

U.S. PATENT DOCUMENTS

| | | | |
|---|---|---|---|
| 5,974,760 | A | 11/1999 | Tingley |
| 6,139,667 | A | 10/2000 | Sanford et al. |
| 6,158,189 | A | 12/2000 | Lau |
| 7,356,974 | B2 | 4/2008 | Tadich |
| 8,166,724 | B2 | 5/2012 | Lemyre |
| 8,640,429 | B1 | 2/2014 | Watts et al. |
| 8,820,034 | B1 | 9/2014 | Watts et al. |
| 9,038,347 | B2 | 5/2015 | Gundersen |
| 2002/0157337 | A1 | 10/2002 | Hovenier |
| 2005/0166522 | A1 | 8/2005 | Griffith |
| 2007/0227095 | A1 | 10/2007 | Hubble |
| 2007/0251174 | A1 | 11/2007 | Chung |
| 2008/0250747 | A1 | 10/2008 | Johnson et al. |
| 2010/0293889 | A1 | 11/2010 | Deboef |
| 2014/0174017 | A1 | 6/2014 | Gundersen |
| 2015/0225956 | A1 | 8/2015 | Gundersen |

* cited by examiner

STRUCTURAL BUILDING ELEMENT

This application is a continuation of U.S. Non-Provisional Application Ser. No. 14/838,872, filed Aug. 28, 2015, the entire disclosure of which is incorporated herein by this reference.

TECHNICAL FIELD

This invention relates to a structural building element. More particularly, this invention relates to roof or floor frame supports. Still more particularly, this invention concerns beams for building construction and particularly timber beams for house construction.

BACKGROUND

The following references to and descriptions of prior proposals or products are not intended to be, and are not to be construed as, statements or admissions of common general knowledge in the art. In particular, the following prior art discussion does not relate to what is commonly or well known by the person skilled in the art, but assists in the understanding of the inventive step of the present invention of which the identification of pertinent prior art proposals is but one part.

It is known to build floor joists from a top and bottom chords with an open web made of a pair of zigzag steel strips nailed to the sides of the timber chords. The chords may be spliced to each other with halving joists. Such a joist is described in US 2006/0156677 A1.

SUMMARY OF INVENTION

Technical Problem

The steel joists leave no pathway for ducts, pipes and cables to cross the building through the joists. The earlier timber joists have great shear strength but limited torsional strength. By trading off shear strength the inventor has achieved significant advantages.

The apparatus aspect of the invention provides a timber T or I-beam comprising a top plate and/or a bottom plate forming the flanges of an I-beam and a series of side by side timber blocks, each separated from the next by a gap, together forming a uniplanar intermittent web, the blocks oriented so that their grain extends transverse to the general longitudinal axis of the top plate.

In this document, in discussing the terms flange, chord or plate, the word "chord" generally refers to an elongate length of timber forming part of a truss, the word "flange" refers to an elongate length of timber forming part of a beam, whereas the word "plate" is used as a generic term. In discussing the words "board" or block", these words are generally interchangeable and generally refer to a short span of timber extending from a plate or between a pair of plates. The pitch or rake of a roof surface, or the roof frame or truss members that support and/or form part of the roof structure, describes the angle of inclination achieved on the surface.

The I beam may be used as a building element of a roof truss or other roof frame. The top and bottom plates may extend parallel to one another. The blocks may be cut square. The top and bottom plates may be set at an incline with respect to one another. The top plate may be set on an incline relative to the square bottom edge of each of the blocks or may extend parallel thereto. The rake of an inclined plate may be minimal, for example around 3°. The rake may vary to achieve roof pitches between 1° and 45°. Where the T or I beam forms an A-frame, a double rake may be provided.

The top and bottom plates may be made of timber of a width larger than the thickness of the boards forming the web. The term plates is used in the framing sense in that they are the horizontals which act as a contact surface for other components and connect the upright parts of the beam.

The blocks may be of rectangular section, or trapezoid or other irregular shape to follow the desired inclined surface of the plate. The face of the plate which contacts the web may be prepared to include grooves or may be rough sawn.

Advantageously, the rake on the plate may be 1° to 3° and still require no modifications of the rectangular sectioned blocks. Greater raking will generally require planing or cutting of one end of the block to follow the incline of the plate.

The depth of the plate may be 25-110 mm, the width 30-150 mm.

The web may extend along at least the intermediate part of the beam. The ends of the I or T beam may be devoid of gaps in order to provide a beam which can be docked at one or both ends. So the blocks at one or both ends are greater lengthwise than the blocks separated by gaps.

The blocks are aligned so that their grain extends transversely relative to the T or I beams longitudinal axis. It is believed that significant gains in torsional strength are achieved whilst trading off on shear lineal strength, which is still more than sufficient due to the tensional strength of the plate and the blocks aligned with their grains generally transverse to the longitudinal axis of the plates.

The horizontal sides of the blocks may also be planed and secured to the plates by adhesive. The sides of the blocks may project slightly into a longitudinal shallow housing in the plates.

The width of the gaps may be equal along the length of the beam. The gaps width may be substantially equal to the length (the direction parallel to the longitudinal axis of the plate) of the blocks. The gap width will normally be selected to allow plumbing pipes, airconditioning ducts and extractor ducts to pass through thereon, together with smaller components such as water pipes and cables. The gap range may be preferably 90-500 mm.

The beam may be made from structural pine for internal use. For external use treated pine of structural grade containing arsenic is suitable. Laminated timber plates and blocks may be used instead but at higher cost. The type of material used to form such I-beams and T-beams as described herein in accordance with the invention may be made from machine grade pine (MGP) or laminated veneer lumber (LVL), the latter being considered a generally higher grade material. Such materials may be used to achieve beams having short duration modulus elasticity (E values) of 6,100-21,500, preferably about 10,000, which correspond to MGP10. Most typically I-beams made according to the invention are required to conform to stress grade standards of F5-F27, but most typically will fall within the stress grade range of F8-F17, corresponding to E values of 9,100-14,000. For house construction, the plates may be 45-90 mm and preferably 70-90 mm in width and 35-45 mm in depth. The blocks may be 70-190 mm, preferably 90-140 mm in length (the direction parallel to the longitudinal axis of the plate), 90-190 mm, and preferably 35-45 mm in depth, noting that the height between the plates may vary depending on the application.

Polyurethane adhesives suffice for indoor work. Exterior polyurethane glues are preferable for joints which support balconies and outdoor structures.

Advantageous Effects of Invention

1. The beam is versatile in the way it incorporates into existing building construction.
2. Its gaps allow transverse passage of pipes, ducts and cables.
3. It offers a useful range of spans.
4. It is economical in that it allows utilisation of short pieces of block which would otherwise be scrapped.
5. It permits the economical production of timber I and T construction beams.
6. By orienting the blocks transversally, it permits the production of raked roof truss elements with minimal modification of component parts relative to beams with parallel plates. The narrower block width allows an inclined beam surface to still rest stably on its end, even if minimally raked by an incline of, say, 1°-3°.
7. It allows efficient production of a range of raked roof truss elements through a range of inclinations by simple cutting of the angles of the respective blocks to length and inclination.

BRIEF DESCRIPTION OF DRAWINGS

Various embodiments of the invention are now described with reference to the accompanying drawings, in which.

DESCRIPTION OF EMBODIMENTS

Figure 1:
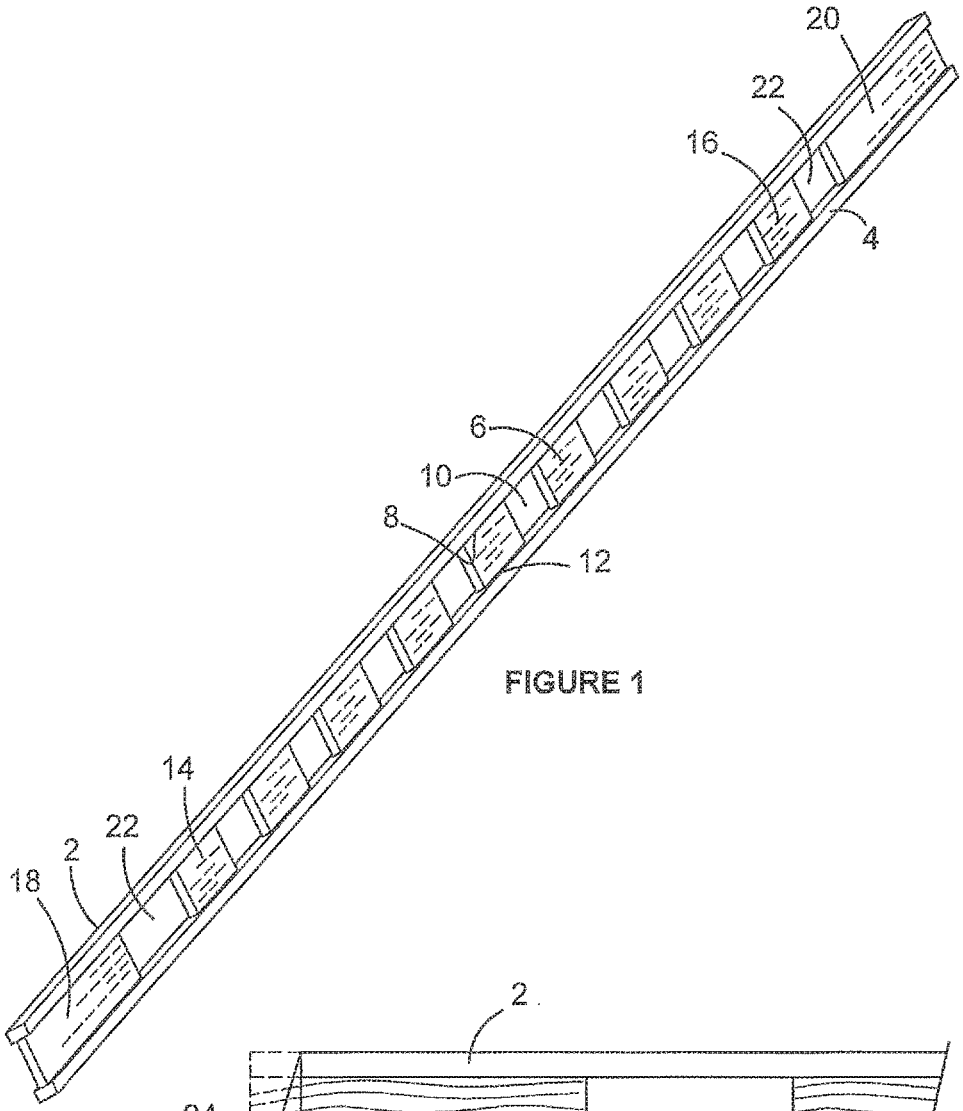
FIG. 1 is a perspective of a 6 m beam.

Referring now to FIG. 1, the beam is made of structural pine. Top chord 2 and bottom chord 4 are made of sawn 6000×90×35-45 mm scantlings. Laser guided sawing is adequate surface finish. The web is made of nine boards, 198×240×45 mm, the sides 8 of which are glued to the faces of the chords with polyurethane. The grain of the boards lies parallel to the chords. The boards are separated from each other by a 190-320 mm rectangular gap 10 which is large enough to admit 90 mm PVC tubes or 300 mm duct. The chords 2, 4 create a 23 mm wide step 12 where the board meets the chord. The nine web boards 6 are separated from each other by eight equal gaps. The two outer boards 14, 16 are separated from the outermost boards 18, 20, each a minimum 600 mm long by gaps 22, each 198 mm wide. These can be varied in gap width to suit the construction for which they are intended. The outermost boards are made intentionally about 2.5 times the length of the web boards 6 to allow onsite docking if necessary.

Figure 2:
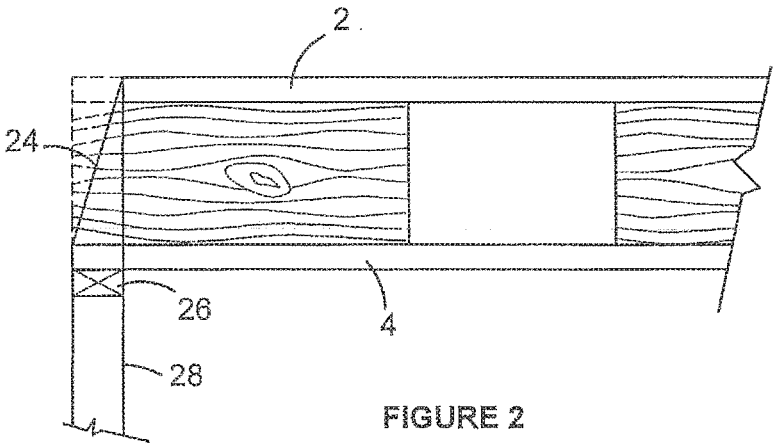
FIG. 2 is a side view of the beam when chamfered at the end support.

In FIG. 2 outermost web board 18 and the overlying end of chord 2 are docked at incline 24 to allow the beam to rest on plate 26 within the thickness of stud wall 28.

Figure 3:
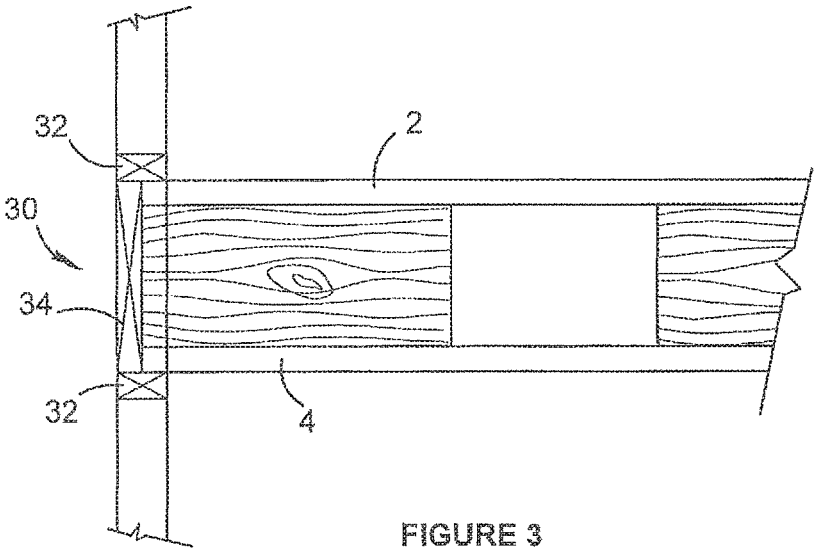
FIG. 3 is a side view of the beam supported at one end in an alternative manner.

In FIG. 3 chords 2, 4 project into the walls top and bottom plates 32, whereafter the end blocking board 34 is fixed to the members 2, 4, 34.

Figure 4:
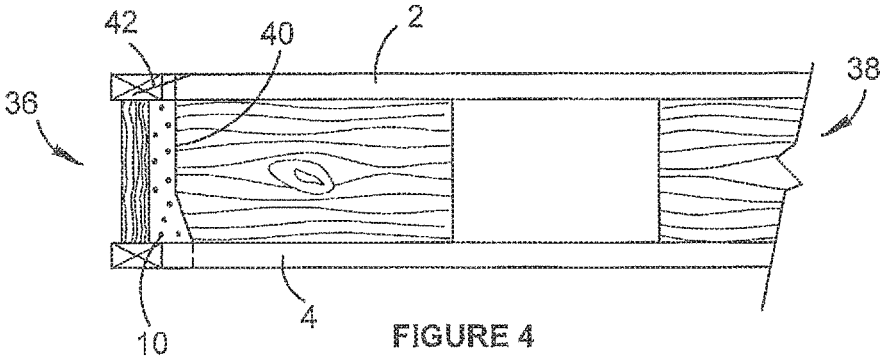
FIG. 4 is a side view of two beams joined at 90 degrees.

In FIG. 4 beam 36 intersects beam 38 at 90 degrees. Both chords 2, 4 are cut back to allow outermost board 16 to project into the space between steps 10. A steel joist hanger 40 mutually connects the beams. The top chords of both beams are united by skew nail 42.

Figure 5:
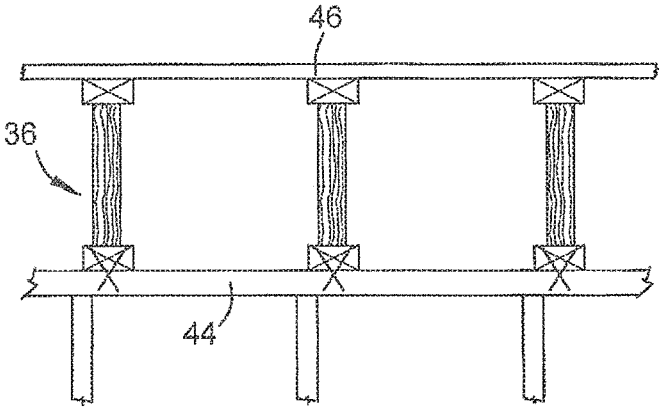
FIG. 5 is an end view of the beam supported on a conventional stud wall.

FIG. 5 shows an end view of a plurality of the bottom chords of beams 36 that are skew nailed to the top plate 44 and particle board flooring 46 is fixed to the top chords.

Figure 6:
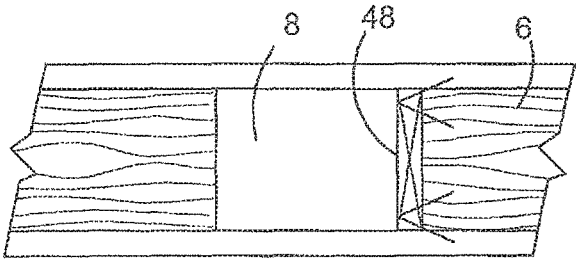
FIG. 6 is a side view showing the beam intersecting with a mid span/end span blocking lying in one of the gaps.

In FIG. 6, when the beams are arranged in a parallel series across a building they are stabilised by the insertion into gap 8 of a common structural board such as a strongback 48 which is skew nailed to the chords and the upright end of web board 6.

Figure 7:
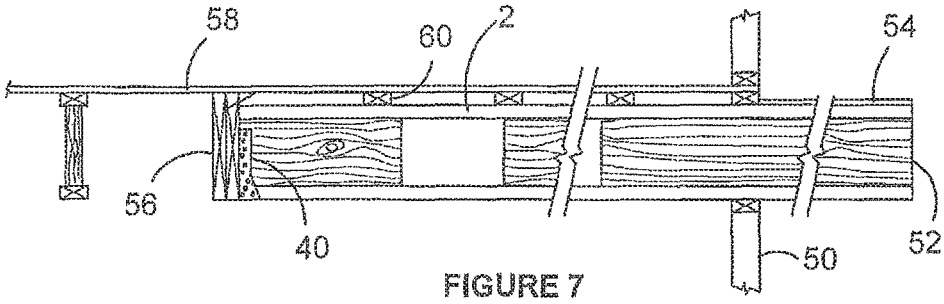
FIG. 7 is a side view of part of a floor with the beam beneath projecting outside the first floor timber wall as a cantilever.

In FIG. 7 ground floor timber supporting wall 50 supports the beam such that it acts as a cantilever. The projecting extension portion 52 supports exterior flooring 54. The end which is inside the building is connected by a joist hanger 40 to a twin beam 56 which abuts floor 58. Packers 60 lie between top chord 2 and inside floor sheets 58.

Figure 8:
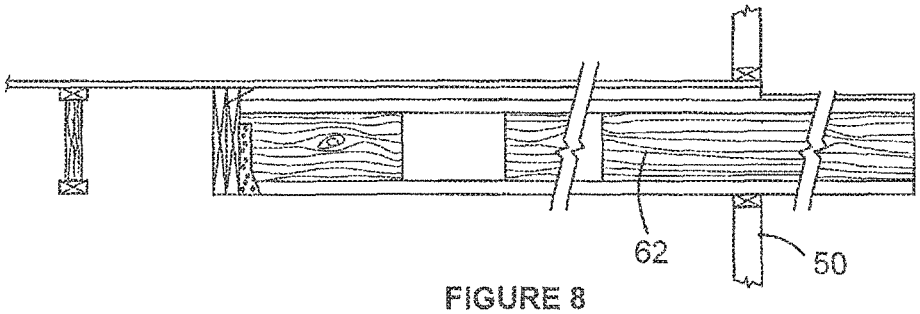
FIG. 8 is the same as FIG. 7 with alternative detail.

In FIG. 8 the endmost board 62 is made of treated pine and covered with exterior flooring sheets 54.

Figure 9:
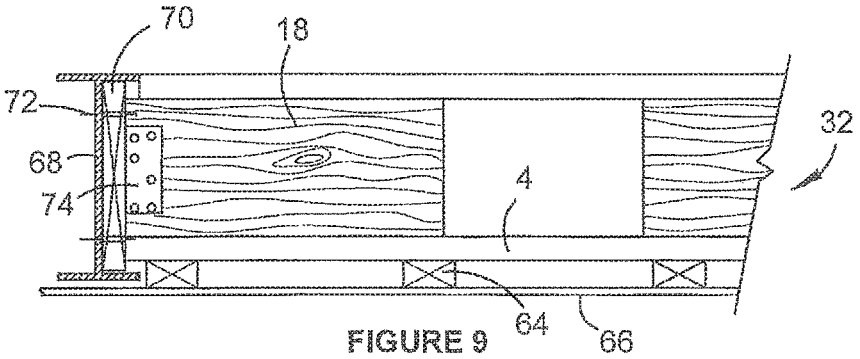
FIGS. 9, 10 and 11 are side views of the beam connected in alternative ways to a steel I-beam.

In FIG. 9 ceiling battens 64 are fixed to bottom chord 4 to take plaster board sheets 66. A steel I-beam 68 supports the timber beam 32. A 35 mm timber packer 70 is secured to the web of the steel beam 68 by bolts 72 and angle bracket 74 joins outermost board 16 to the packer 70. The chord 2 is cut back to allow the appropriate insertion.

Figure 10:
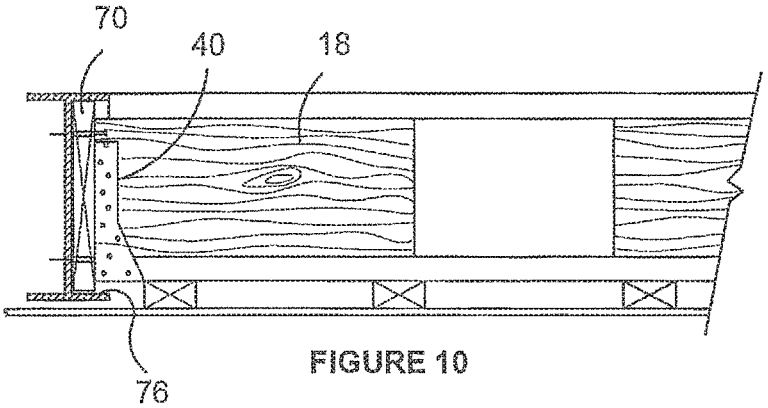

In FIG. 10 the same arrangement is shown again with packer 70 resting on the flange 76 of the I-beam. Instead of bracket 74, steel joist hanger 40 connects outermost board 16 to the packer.

Figure 11:
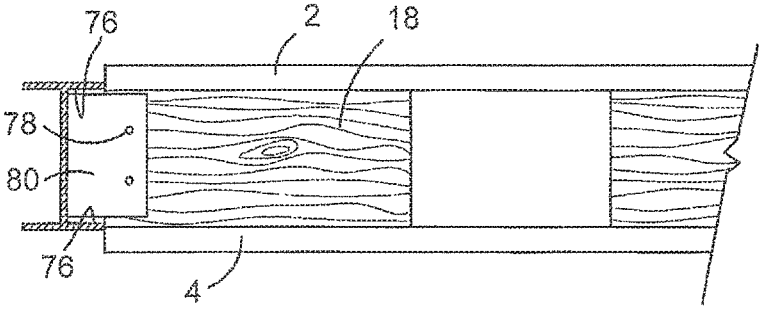

In FIG. 11 the chords are cut back to allow the outermost board 16 to project between the steel I-beam flanges 76. The board is fastened with bolts 78 to cleat plate 80.

Figure 12:
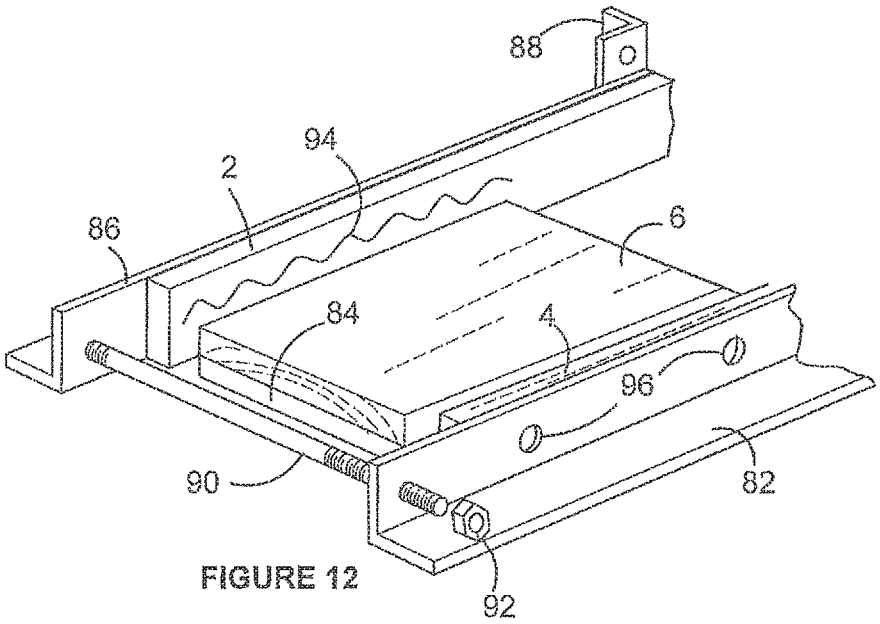
FIG. 12 is a diagram of a jig in which the beam components are arranged prior to glueing.

In FIG. 12 a jig for beam assembly is shown, wherein a first angle iron clamp 82 is positioned alongside a row of flat, horizontal spacer supports 84 intended to raise the web boards. An opposing angle iron clamp 86 is positioned alongside and parallel to the row of spacers 84. Posts 88 are welded to the clamps at mid point and the posts are joined by threaded rods 90. Nuts 92 impose the clamping force.

The chord plates 2, 4 are laid between the spacers and the clamps and the boards 6 are aligned with the spacers. Glue 94 is applied from a gun and the clamps are tightened. In some beams the grain of the boards lie at 90 degrees to the axis of the plates.

The clamps have pairs of holes 96 for each board so that nails can be inserted through the clamps, the plates 2, 4 and into the boards 6 after gluing.

Figure 13:
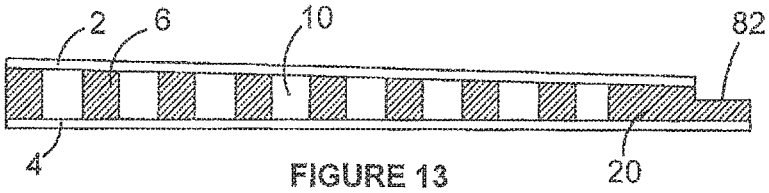
FIG. 13 is a side view of a plano-convex beam.

Referring now to FIG. 13, the beam has a top plate 2 and a bottom plate 4 joined by web boards 6. The gaps 10 between boards are the same but the outermost board 20 has a cut out 82 measuring 345×120 mm. The LH end of the beam is 405 mm deep and though the beam length varies, the outermost end of the beam would typically be 300 mm. The saw is programmed to modify the depth of the web boards to reduce the beam height from the inner end to the outer end. This achieves the pitch required to make a flat roof self draining. However, because the web boards 6 have substantial length the direction of the I-beam axis, they each must be individually cut, despite the shallow raked angle of 1-2°. However, it is not possible to cut them too short in their axial grain orientations.

Figure 14:
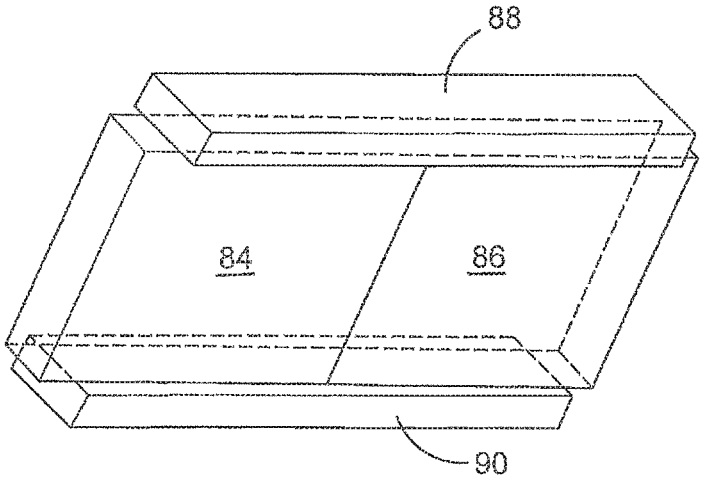
FIG. 14 is a side view of a biconcave beam.
Figure 15:
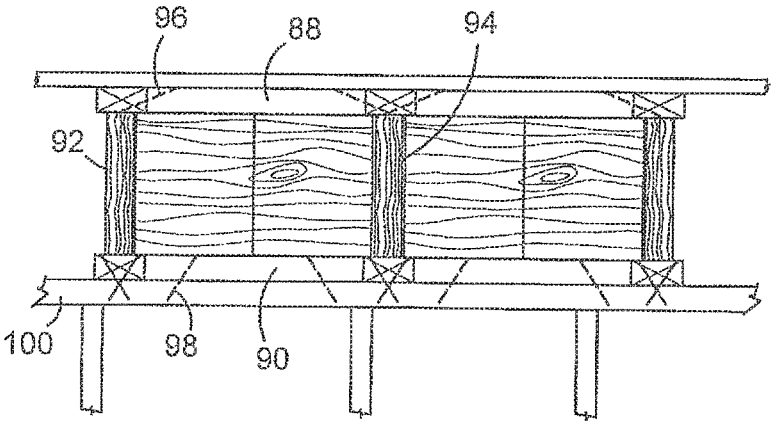
FIG. 15 is an end view of three I-beams braced by two bracing components.

In FIGS. 14 and 15 a pair of brace boards 84, 86, the same depth as web boards 6 in FIG. 13, are glued and nailed to top plate 88 and bottom plate 90. The boards lie end to end in contact and project 22 mm beyond the plates at both ends.

The purpose is to lead to installation as shown in FIG. 15. Here the component is lowered into the gap between a pair of adjacent parallel I-beams 92, 94 and rotated to lie 90° to both. Alternatively, the bracing component may be installed as the I-beams are laid. The plates 88 and 90 are skew nailed to the top plates of the I-beam alongside using nails 96 and to the wall plate beneath using nails 98.

Figure 16:
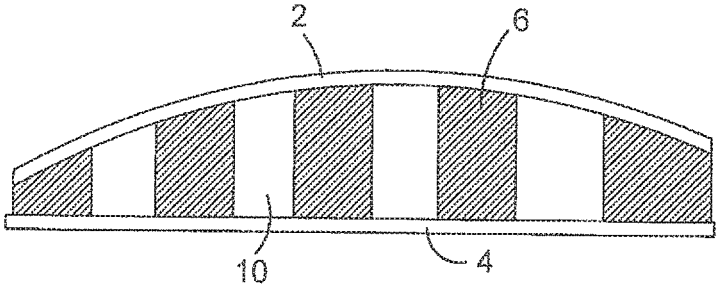
FIG. 16 is a side view of a plano convex beam of I-section.
Figure 17:
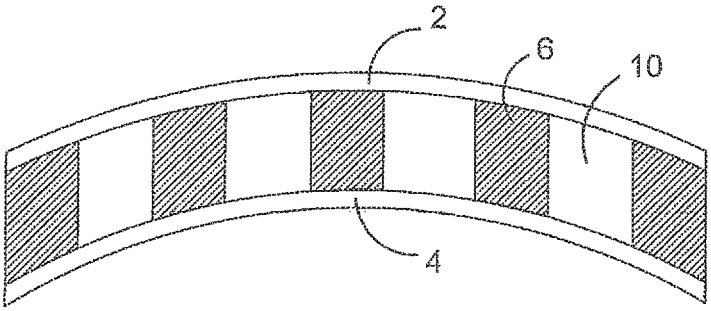
FIG. 17 is a side view of a biconcave beam of I-section.

Referring now to FIG. 16, a top plate 2 is laminated to produce a convex shape as shown. A saw bench which docks the boards 6 is programmed to cut the boards 6 in a series to produce the shape shown. The jig is modified accordingly. Likewise in FIG. 17, the jig is further modified to produce the biconcave beam shown.

Figure 18:
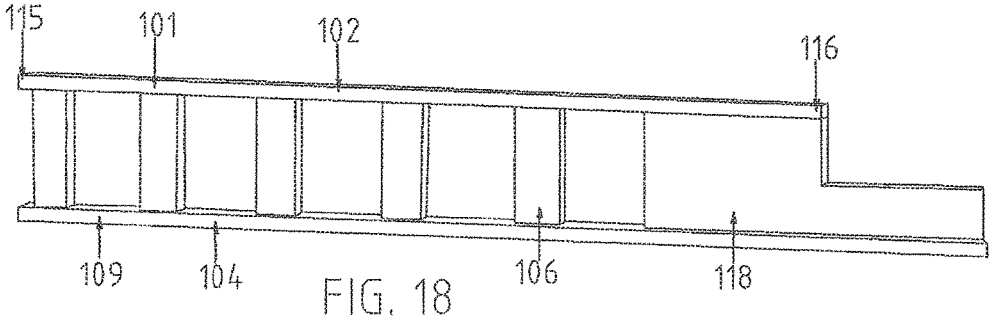
FIG. 18 is a side view of a slightly raked beam of I-section.

Turning to FIG. 18, there is shown a raked I-beam comprising a lower chord 104 and an upper chord 102 interposed by equispaced blocks 106. The lower chord 104 extends flat along a tabular jig 109, whereas the upper chord 102 declines at an angle (about 0.5-30°, preferably about 0.5-5°, and most preferably 1.5° from an end point 115 to an outer end 116, where the I-beam 101 is cut to suit outer roofing profiles, such as guttering and outer frame structures, and for this reason the outer most block 106 comprises a board 118 that can be docked and cut to shape and size to suit the desired profile as shown in the drawing. It is noted that the description in relation to FIG. 18 is with regard to an A-frame I-beam, but the relevant description is applicable to single raked I-beams, such as those shown in FIG. 20.

Figure 19:
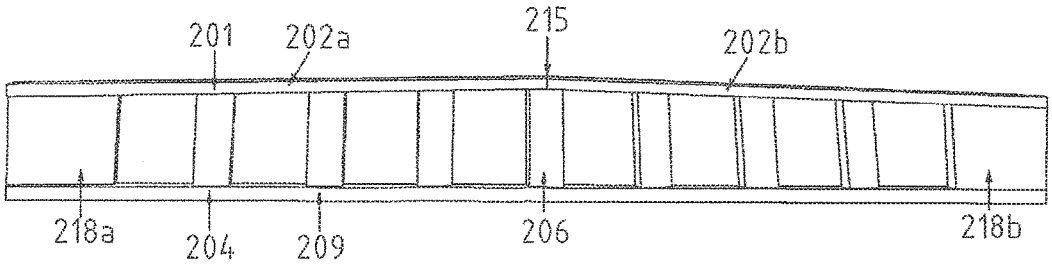
FIG. 19 is a side view of an A-frame beam of I-section, slightly raked from a centre high point.

Turning to FIG. 19, a shallow A-frame 201 is shown having a high centre point 215 from which the raked upper chords 202*a,* b decline either side of the centre point 215. The lower chord 204 lies flat on the planar jig 209 and interposed between the lower and upper chords 202, 204 are a plurality of equispaced blocks 206 advantageously cut square to minimize costs, each block 206 beam cut the length to support the upper chords 202*a,* b in raked position through to the outer most long board 218 a, b at either end.

Figure 20:
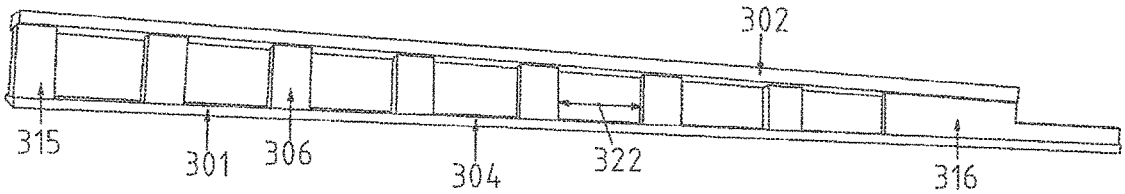
FIG. 20 is a side view of a raked beam of I-section.
Figure 21:
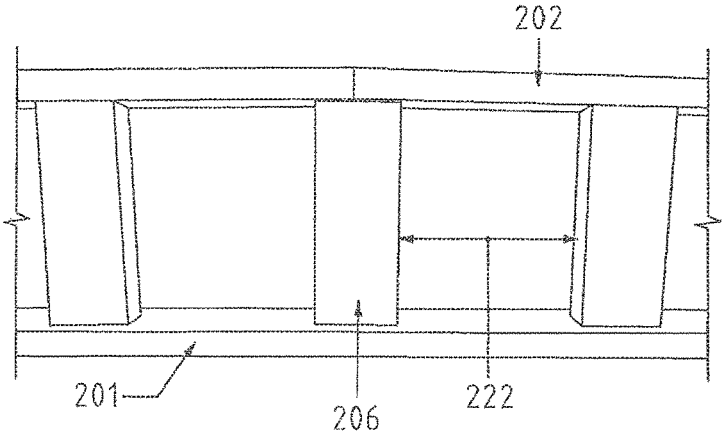
FIG. 21 is an amplified view of the centre point of the embodiment shown in FIG. 19.

In FIG. 20, single raked I-beams are shown having a pair of upper and lower chords 302, 304 that are most likely spaced at a first end point 315 and converge at an angle of about 2-5° to a second end point 316. As with the embodiment shown in FIG. 18, the single raked I-beam 301 comprises a plurality of blocks 306 each spaced to support and brace the upper and lower chords 302, 304. Interstitial spaces 322 provide gaps to allow ducting, wiring and other building services to be passed through the I-beam 301 during the building phase, as well as once the building is erected. As shown in FIG. 21, the interstitial spaces 222 of A-frame I-beam 201 may be in registry with one another in situ to enable the passage of such building services. The blocks 206 may be cut square where the raking angle is shallow, such as 1-5°, or may be cut at one end to conform to the angle of incline to ensure that the upper chord 202 rests stably on each block 206, as will be explained in more detail with reference to FIG. 26.

Figure 22:
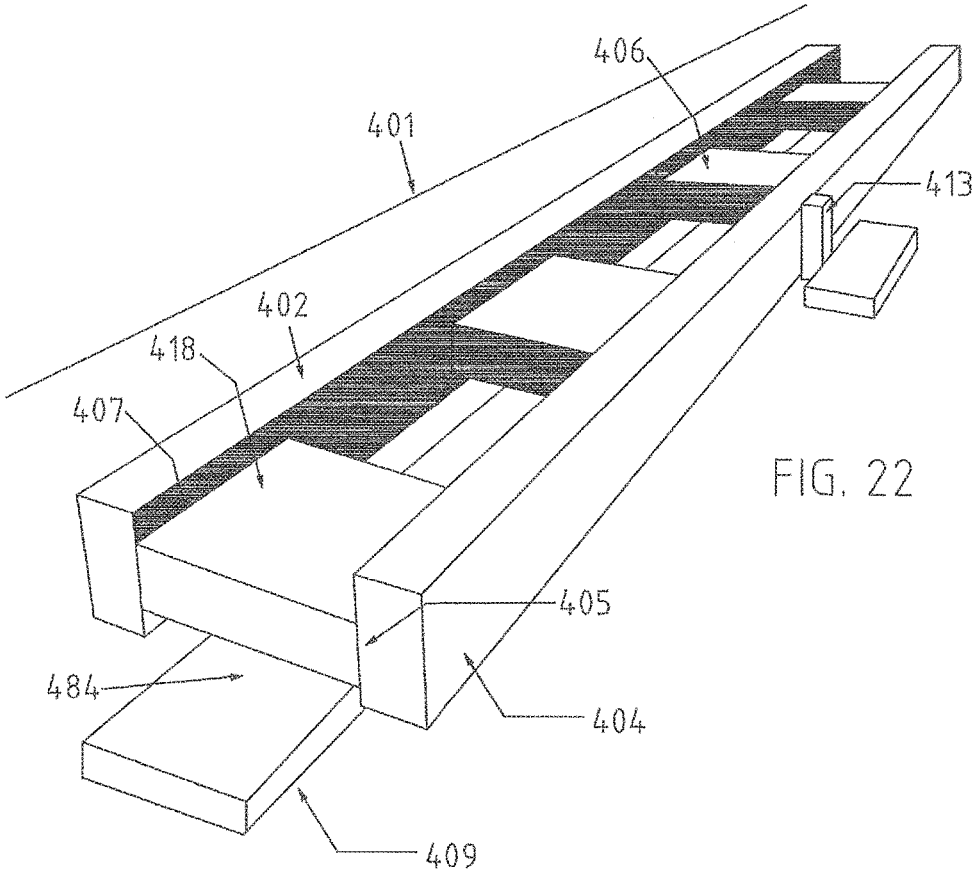
FIG. 22 is a perspective view of an I-beam in the process of being manufactured.

With reference to FIG. 22, during manufacture the upper and lower chords 402, 404 may be placed on a planar jig table 409 and braced in place using spacer blocks 413. Initially only one chord 404 is placed in position, glue is applied to predetermined regions on the chords internal surface 405 who correspond with the positioning of the end of face of each block 406, 418 that is to be placed in that glued region, the glue being a high strength semi-rigid external use polyurethane adhesive. The blocks 406, 418 are positioned in place and supported, spaced above the tabular jig 409 in a parallel horizontal plane by board spaces 484 positioned between the table 409 and the boards 406, 418. The second upper chord 402 is then placed with its wide face against the other end of the blocks 406, 418, but not before adhesive is similarly applied to corresponding regions along its inner face 407.

Figure 23:
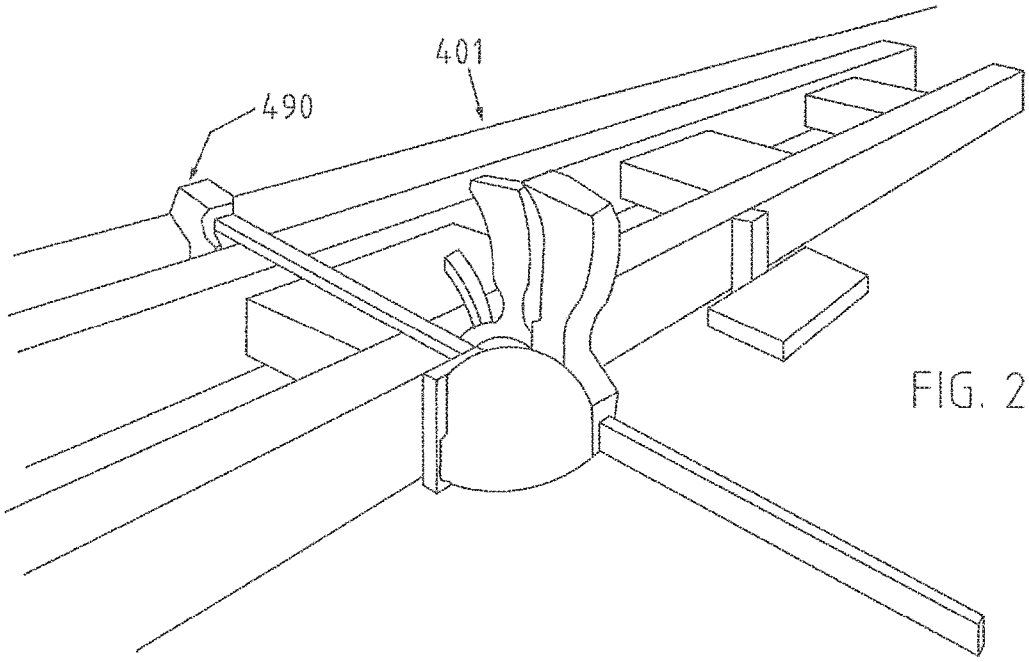
FIG. 23 is a perspective view of the I-beam of FIG. 22 during manufacture.
Figure 24:
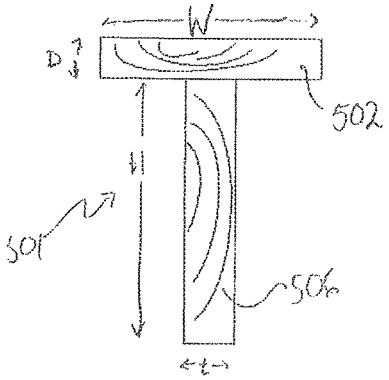
FIG. 24 is an end schematic view of a timber T-beam.

As shown in FIG. 23, the upper and lower chords 404, 402 are then compressed together by clamps 490 and the boards, blocks 406, 418 are secured in position between the upper and lower chords 402, 404 by the application of nails through the outer surfaces of the chords 402, 404 into the ends of the blocks 406, 418 to secure the blocks 406, 418 until the adhesive can form a strong bond, noting that it is the adhesive that provides the long term mechanical strength or the I-beam 401. During manufacture, preferably a pair of nails 712 are inserted through the upper and lower chords 702, 704 into each block 706 at each end of the block 706 to prevent twisting. To further secure the I-beam structure 701, screws 711 are inserted intermittently along the length of the I-beam 701 to hold or further clamp the boards or flanges 702, 704 in place against the adhesive 707 until the adhesive 707 sets, preferably at 500-1500 mm intervals along the length of the I-beam 701.

The I-beam 401 is then removed from the jig 409 and the process is repeated to form a new I-beam 401.

The adhesive may be a high strength, semi-rigid polyurethane glue.

Turning to FIGS. 24, 25, 30 and 31, the I-beam may be substituted with a timber T-beam that may be defined with respect to the following dimensions:

W=width of the chord, which may typically be 30-150 mm, preferably 44-120 mm, and most preferably 70-90 mm;

D=depth of chord 502 which may be 25-110 mm, more preferably 30-70 mm, and most preferably 35-45 mm;

H=height of block 50-400 mm, most preferably 70-290 mm, noting that H can vary depending on the pitch of the truss I-beam or T-beam, the position of the block 506 along the length of the I-beam or T-beam 501 and the mechanical properties required of the block 506 for the particular application;

t=thickness of the block 506 which may be 19-90 mm, but more preferably 35-45 mm.

Note: The web of the T-beam may or may not be continuous.

Figure 25:
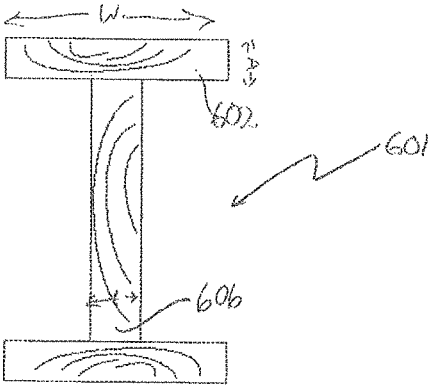
FIG. 25 is an end schematic view of a timber I-beam according to the invention.
Figure 30:
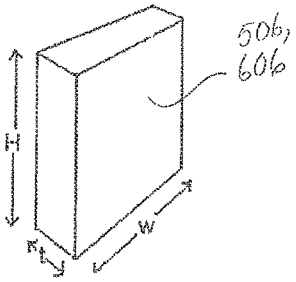
FIG. 30 is a perspective view of a block.
Figure 31:
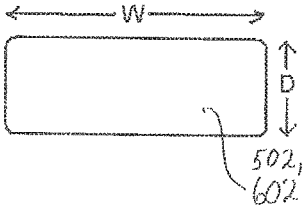
FIG. 31 is a schematic end view of a plate.

Similarly, with respect to the I-beam 601 shown in FIG. 25 and more clearly shown in FIG. 30, the block t value may be 10-90 mm and preferably 35-45 mm, the latter using F grade or machine graded pine (MGP). The value w may be 50-240 mm, preferably 70-140 mm, and most preferably 70-90 mm. The raking angle may vary to accommodate different applications and may be between 0.4°-45°, with H being varied with the pitch angle.

The I-beam 601 of FIG. 25 is shown as having a top chord 602 and a bottom chord (following the reference conventions in the original specification, ascribed reference No. 604). The top and bottom chords 602,604 are spaced from each other. Interposed between the top and bottom chords 602,604 is a web comprising a series of rectangular blocks 606, each block having a top and a bottom end.

As shown in FIG. 30, the rectangular blocks 606 are square cut, the top chord 602 has only a single face of an inner face (following the reference conventions in the original specification, ascribed reference No. 607) and the bottom chord 604 has a single face of an inner face (following the reference conventions in the original specification, ascribed reference No. 605).

In the completed I-beam 601, the single inner face 607 of the top chord 602 comprises one continuous and planar surface facing inwardly towards the corresponding opposed inner face 605 of the bottom chord 604. The top and bottom chord inner faces 607,605 abut the respective square cut end faces of the blocks 606 at respective top and bottom interfaces (ascribed reference No. 608). The inner faces 607,605 are substantially flat and have no groove features to engage with the end faces of the blocks. The long term engagement at the interfaces 608 is effected by an adhesive bond.

Figure 26:
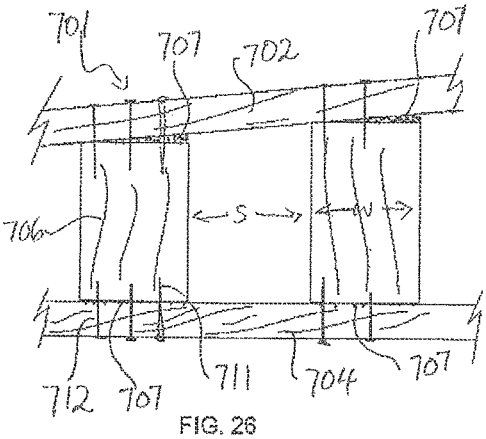
FIG. 26 is a side art cross sectional view of a raked I-section beam according to the invention.

As shown in FIG. 26, the achievement of blocks 706 having a relatively small w value (for example 70 mm, and in some applications, as low as 45 mm), allows the block 706 to be cut square whilst still adequately supporting the inclined raking chord or flange 702.

Figure 27:
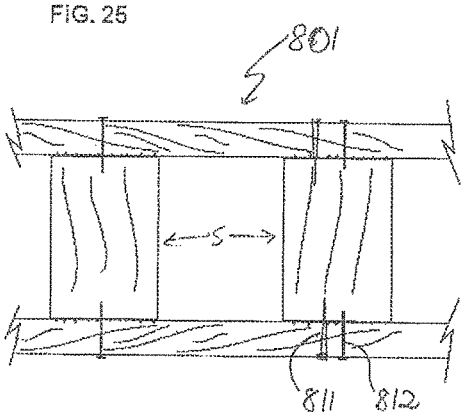
FIG. 27 is a side schematic part view of an I-beam with parallel chords.

A similarly formed I-beam 801 is shown in FIG. 27 formed using similar principles to the I-beam 701 described with reference to FIG. 26.

Figure 28:
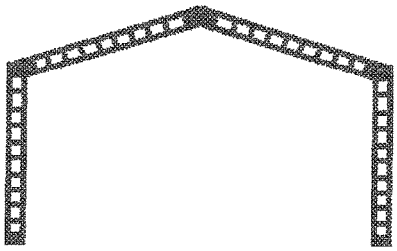
FIG. 28 is an end schematic view of a wall and roof truss frame combination comprising a double raked A-frame roof structure.
Figure 29:
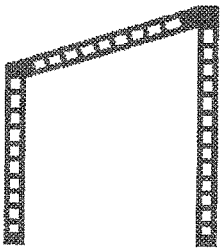
FIG. 29 is an end view of a steeply pitched single raked building structure.

Referring to FIG. 28, there is shown a combined wall frame and roof truss structure using parallel I-beams 801 made according to the invention. In FIG. 29, there is shown a building structure with a single inclined I-beam span. It is noted that the parallel chords of the portal structure shown in FIGS. 28 and 29 can be replaced with dual raked roof truss structures (for the example shown in FIG. 28) and with a single raked I-beam structure (see the example shown in FIG. 29).

It is to be understood that the word "comprising" as used throughout the specification is to be interpreted in its inclusive form, ie, use of the word "comprising" does not exclude the addition of other elements.

It is to be understood that various modifications of and/or additions to the invention can be made without departing from the basic nature of the invention. Materials other than timber are suitable for making into boards. Polymeric timber substitutes are suitable if they have suitable strength. These modifications and/or additions are therefore considered to fall within the scope of the invention.

The invention claimed is:

1. A timber I-beam which falls in a stress grade range of F8-F17which corresponds to short duration modulus elasticity (E values) of 9,100- 14,000, said I-beam for use as a roof truss or floor support, the timber I-beam comprising a top chord, a bottom chord, a series of multiple timber blocks adhesively connected to the top chord and the bottom chord, and nails extending through the top chord into at least some of the timber blocks, the I-beam having a first end and a second end forming spaced flanges of the I-beam, the bottom chord extending along a longitudinal axis, said flanges spaced from each other and supported by said series of multiple timber blocks lying in a single plane and each separated from the next by an interstitial gap adapted to receive building services, said series of multiple timber blocks comprising a first-end block at said first end of the I-beam, a second-end block at said second end of the I-beam, and a plurality of blocks spaced between first-end block and the second-end block, the I-beam forming a uniplanar, intermittent web, wherein:

each of the top chord and the bottom chord has a right side outer surface and a left side outer surface and a single inner face that extends on a single plane continuously from the right side outer surface to the left side outer surface, the inner face adapted to face the respective other top or bottom chord;

the upper and lower ends of each block are square cut and adapted to abut the inner face of each of the top chord and the bottom chord;

the inner face of each of the top chord and the bottom chord is substantially flat and the entirety of each of the top chord and the bottom chord has no groove feature to engage with the upper and lower ends of each block;

adhesive is applied between the end faces of the blocks and the respective inner faces of the top and bottom chords, the blocks being secured in position between the top and bottom chords until the adhesive can form a strong bond wherein it is the adhesive that provides long term mechanical strength for the I-beam;

the lengths of the blocks, in a direction parallel to the longitudinal axis of the plate are at least 50-mm and at most 240 mm;

the gaps between the blocks are at least substantially equal to the length of the blocks in the direction parallel to the longitudinal axis and the intervals of the blocks along the length of the I-beam are at most 1500 mm; and the thickness of the blocks is between 19 mm and 90 mm.

2. A timber I-beam as claimed in claim 1, wherein the top and bottom chords extend parallel to one another.

3. A timber I-beam as claimed in claim 2, wherein the top and bottom chords are curved.

4. A timber I-beam as claimed in claim 1, wherein the blocks are of rectangular section.

5. A timber I-beam as claimed in claim 4, wherein the rectangular blocks are interposed between top and bottom chords raked to an angle of 1-5 degrees such that a wedge shaped space is defined between the square cut end faces of the timber blocks and the inner face of the top chord.

6. A timber I-beam as claimed in claim 5, wherein attachment between the respective inner faces of the top and bottom chords and the square cut end faces of the rectangular blocks includes the application of adhesive in the wedge shaped space to provide adequate support to the inclined raking top or bottom chord.

7. A timber I-beam as claimed in claim 1, wherein the width, w, of the bottom chord is about 90 mm.

8. A timber I-beam as claimed in claim 7, wherein the width of each of the blocks is about 45 mm.

9. A timber I-beam as claimed in claim 1, wherein the top chord is raked relative to the bottom chord.

10. A timber I-beam as claimed in claim 1, wherein all of the gaps are of equal width along the length of the I-beam.

11. A timber I-beam as claimed in claim 1, wherein the width of the gaps is substantially greater than the width of the blocks.

12. A timber I-beam as claimed in claim 1, wherein the width of the gaps is at least twice the width of the blocks.

13. A timber I-beam as claimed in claim 1, wherein the top chord is inclined in relation to the bottom chord by 0.4 to 45 degrees in order to support a drainage surface.

14. A timber I-beam as claimed in claim 13, wherein the raked inclination is about 1- 5 degrees.

15. A timber I-beam as claimed in claim 13, wherein the raked inclination is about 0.5 to 5 degrees.

16. A timber I-beam as claimed in claim 1, wherein the I-beam is capable of being made by the following method:

first cutting a plurality of blocks such that their respective end faces are square cut;

placing a top chord on a table jig and applying adhesive to specific regions where the blocks will abut an internal face of the top chord;

positioning the blocks at predetermined spaced intervals along the length of the top chord;

placing a bottom chord on the table jig to abut the free ends of the blocks;

applying adhesive to corresponding regions of the bottom chord's inner face to abut the blocks before fixing the bottom chord in position;

applying clamps to hold the top and bottom chords in spaced relationship against the interposed blocks;

applying a pair of nails to each end of each block through the outer surfaces of each respective chord of the top and bottom chords; and securing the blocks in position between the top and bottom chords until the adhesive can form a strong bond wherein it is the adhesive that provides long term mechanical strength for the I-beam.

17. A timber I-beam as claimed in claim 16, wherein screws are applied to further hold the top and bottom chords to the blocks prior to the adhesive setting.

18. A timber I-beam as claimed in claim 1, wherein the blocks are square cut and interposed between top and bottom chords raked to an angle of 2- 5 degrees.

19. A timber I-beam as claimed in claim 1, wherein the top chord is curved or raked relative to the bottom chord.

20. A timber I-beam as claimed in claim 1, wherein the blocks are interposed between the top and bottom chords that are raked to an inclination of 1- 5degrees.

21. A timber I-beam which falls in a stress grade range of F8-F17which corresponds to short duration modulus elasticity (E values) of 9,100- 14,000, said I-beam for use as a roof truss or floor support, the timber I-beam comprising a top chord, a series of multiple timber blocks adhesively connected to the top chord and the bottom chord, and nails extending through the top chord into at least some of the timber blocks, the I-beam having a first end and a second end, a bottom chord forming spaced flanges of the I-beam, the bottom chord extending along a longitudinal axis, said flanges spaced from each other and supported by said series of multiple timber blocks lying in a single plane at locations along the length of the I-beam and each block separated from the next by an interstitial gap adapted to receive building services, said series of multiple timber blocks comprising a first-end block at said first end of the I-beam, a second-end block at said second end of the I-beam, and a plurality of blocks spaced between first-end block and the second-end block, the I-beam forming a uniplanar, intermittent web, wherein:

each of the top chord and the bottom chord has a right side outer surface and a left side outer surface and a single inner face that extends on a single plane continuously from the right side outer surface to the left side outer surface, the inner face adapted to face the respective other top or bottom chord;

the upper and lower ends of each block are square cut and adapted to abut the inner face of each of the top chord and the bottom chord;

the inner face of each of the top chord and the bottom chord is substantially flat and the entirety of each of the top chord and the bottom chord has no groove feature to engage with the upper and lower ends of each block;

adhesive is applied between the end faces of the blocks and the respective inner faces of the top and bottom chords at the locations of the blocks along the length of the I-beam; and the top and bottom chords are compressed together, securing the blocks in position between the top and bottom chords until the adhesive can form a strong bond wherein it is the adhesive that provides long term mechanical strength for the I-beam.

* * * * *